United States Patent [19]

Wischusen, III

[11] Patent Number: 4,726,553

[45] Date of Patent: Feb. 23, 1988

[54] DRINKING CUP STABILIZER

[75] Inventor: Henry Wischusen, III, Lilburn, Ga.

[73] Assignee: Rock-Tenn Company, Norcross, Ga.

[21] Appl. No.: 912,831

[22] Filed: Sep. 26, 1986

[51] Int. Cl.[4] ..... A47G 23/02

[52] U.S. Cl. ..... 248/146; 215/100 S; 220/85 H; 248/346.1; 248/359; D7/70

[58] Field of Search ..... 248/346.1, 146, 346, 248/359 A, 359 R, 359.1; 220/85 H, 85 R; D7/70; 215/100.5

[56] References Cited

U.S. PATENT DOCUMENTS

| | | | |
|---|---|---|---|
| D. 103,307 | 2/1937 | Cory | D7/70 |
| D. 281,755 | 12/1985 | Bradley . | |
| 536,353 | 3/1895 | Kickhefel | 215/100.5 |
| 1,461,156 | 7/1923 | Martin | 248/146 X |
| 1,922,127 | 8/1933 | Foley | 248/146 |
| 1,925,241 | 9/1933 | Fullerton | 215/100.5 |
| 2,589,967 | 3/1952 | Sawyer | 215/100.5 |
| 2,784,577 | 3/1957 | Beaham, III | 248/146 |
| 2,908,473 | 10/1959 | Snyder | 248/359 A |
| 3,246,786 | 4/1966 | Holley | 215/100.5 |
| 3,279,638 | 10/1966 | Merry | D7/70 X |
| 3,297,289 | 1/1967 | Raus | 248/346 X |
| 3,598,271 | 8/1971 | Holley | 215/100.5 X |
| 3,632,015 | 1/1972 | Barth | 215/100.5 X |
| 4,101,044 | 7/1978 | Paquette et al. | 215/100.5 X |

FOREIGN PATENT DOCUMENTS

| | | | |
|---|---|---|---|
| 978440 | 4/1951 | France | 215/100.5 |

*Primary Examiner*—David L. Talbott

*Attorney, Agent, or Firm*—Jones, Askew & Lunsford

[57] ABSTRACT

A drinking cup base is provided which may be used as either a coaster or an attached stabilizer in combination with a variety of cups, including disposable cups. In both modes of operation, a cup is placed within a recess in the base, such that the mouth of the base contacts and forms a friction fit with the outside surface of the cup. In this position, the base functions as a coaster, as the friction fit any may be overcome by raising the cup. However, if it is desired to utilize the base as an attached stabilizer, the cup is forced within the recess, forming a vacuum fit, which, combined with the friction fit, maintains the base in continuous attachment to the bottom of the cup, until the cup and base are manually separated. The base includes a spill tray to retain spillage from the cup, and one embodiment of the base includes a turned-back outer rim which maintains the spillage even when the base is tilted during tilting of the cup for drinking.

31 Claims, 4 Drawing Figures

Fig. 2
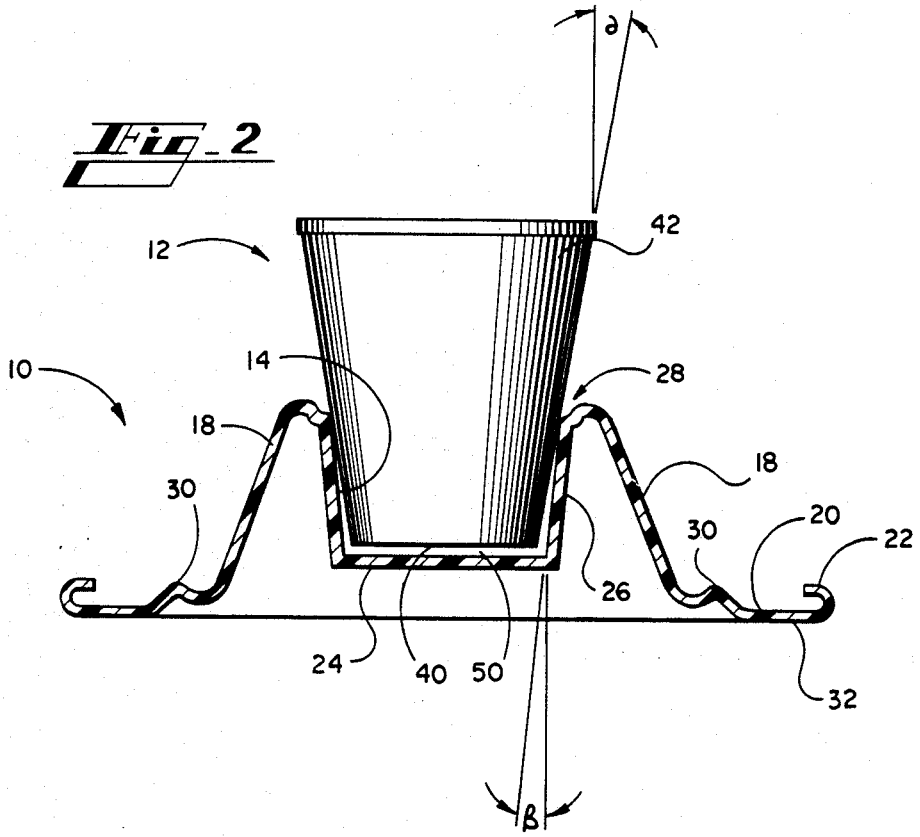
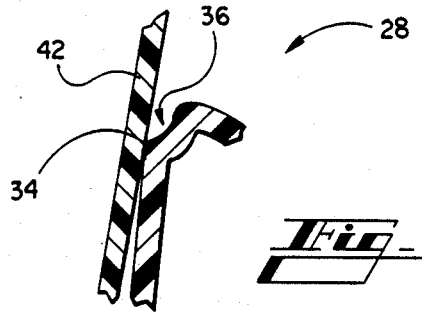
Fig. 3

DRINKING CUP STABILIZER

TECHNICAL FIELD

The present invention generally relates to drinking vessels, and particularly relates to a base which may be selectively attached to a drinking cup, and used as a stabilizer, or alternatively, used as a detached coaster, depending on the preference of the user.

BACKGROUND OF THE INVENTION

In food service, especially fast food service, it is common to provide beverages such as coffee, tea, carbonated colas, or fruit drinks in disposable cups. With the configuration of drinking cups presently in use, it is relatively easy to upset the cups, resulting in accidental spillage of their contents. Such accidents commonly occur, particularly in busy restaurants, and on moving transportation such as automobiles, ships, trains and planes. Therefore it is desirable to provide a cup configuration which is resistant to spillage.

In the development of presently-used disposable cups, various cup configurations have been developed. By far the most common cup configuration includes a circular base, and a conical wall extending upwardly and tapering outwardly from the outer perimeter of the base, then terminating to form a circular mouth. This mouth is normally larger in size than the base, with the cup configuration being similar in shape to an inverted truncated cone. This configuration allows the cups to be readily and conveniently stacked in a nesting relationship, resulting in space savings. However, as previously discussed, this configuration tends to be unstable, or "topheavy", when containing a fluid. It has been known to provide cups having a taper in the opposite direction, with the base having a greater diameter than the mouth to provide stability to the cup but this configuration does not allow the cups to be stacked.

Therefore it has been known to provide a detachable supporting base which attaches to the lower portion of a cup, and provides more stability to the base. Examples of such detachable stabilizing devices are disclosed by Kickhefel (U.S. Pat. No. 536,353), Fullerton (U.S. Pat. No. 1,925,241), Sawyer (U.S. Pat. No. 2,589,967), Holley (U.S. Pat. No. 3,246,786), Holley (U.S. Pat. No. 3,598,271), and Barth (U.S. Pat. No. 3,632,015).

Sawyer discloses the use of a selectively detachable base configured to accept and grasp the lower portion of a cup, by providing a friction fit between the outside walls of the cup and a mating upstanding annular flange.

Kickhefel discloses the use of a drip stand having two halves, and also having a pair of springs each having one end attached to each of the halves such that the halves combine to define a circular cup-accepting recess. As a cup is placed within the recess, the two halves separate against the urging of the springs, and the springs act to bias the halves against the outer walls of the cup, creating a friction fit between the drip stand and the cup.

Holley '217, and Holley '786 each discloses a combinaton cup lid-base which may be alternately placed atop the mouth or the base of a cup. It should be noted that Holley '271 further discloses one embodiment which may be inverted, exposing a flat surface upon which the cup may be placed. When inverted as such, the device does not attach to the base, but acts as a coaster.

Berth discloses the use of a saucer having a cup-retaining recess configured to accept the lower portion of a cup and form a friction fit between the outer walls of the cup and the inner walls of the recess. A suction sup is provided on the underside of the saucer, which is configured to adhere to a supporting surface.

Fullerton discloses the use of a anti-drip coaster for accepting a drinking cup including a suction cup and an annular upturned ridge. The suction cup is configured to attach to and maintain a grip on the underside of the drinking cup. The upturned ridge is configured such that any spillage from the cup will be retained within the coaster even when the cup is positioned for drinking. It should be understood that the suction fit disclosed in Fullerton is limited in effectiveness to cups having a smooth underside such as that provided by glass or ceramic.

Although these devices do provide selectively detachable bases for conventional fluid containers, they are limited in effectiveness and versatility, as they are intended to accept only a particular cup configuraton. The devices disclosed in Sawyer, Holley '786, and Holley '271, may only be attached to cups having a particular base size and side wall draft. The device disclosed in Fullerton is only effective when used with cups having a smooth, flat, hard underside, such as reusable glass or ceramic cups. Therefore a need exists for a cup stabilizer which may be used with a variety of cups, including disposable cups, which may have a variety of side wall drafts.

At times, it is also desirable to provide a drinking cup coaster which is not attached to the cup, but instead is placed upon a support surface (such as a table) to provide an intermediate barrier between a support surface and the cup base, to prevent moisture or spillage from the cup from staining or damaging the support surface.

Various coasters have been provided which provide such a barrier. These devices are typically flat, and may be composed of a plastic-laminated paperboard, cork, glass, or other similarly insulative material. However, it should be noted that these devices typically do not attach to the cup, and do not provide any stability to the cup.

As previously discussed, the detachable base of Holly '271 may also be used as a coaster. However, it must be inverted from its cup-stabilizing position, which is an inconvenience to the user.

Therefore it may also be seen there is also a need for a drinking cup attachment which accepts a wide variety of conventional cup configurations, and may be selectively and conveniently used as either a detached coaster or an attached stabilizing base and drip retainer, depending upon the preference of the user.

SUMMARY OF THE INVENTION

The present invention solves problems with prior art devices by providing a drinking cup attachment which accepts a wide variety of conventional cup configurations, and may be selectively and conveniently used as either a detached coaster or an attached stabilizing base, depending upon the preference of the user.

Generally described, the present invention provides a combination drinking cup coaster-stabilizer for attachment about the base of a drinking cup and for placement upon a surface, comprising a base having a recess configured for accepting the lower portion of an upright drinking cup and maintaining the cup in an upright position, and having an annular rim disposed about the mouth of the recess for continuous contact about the outer surface of the cup such that a vacuum may be formed in the recess for maintaining the cup within the base.

It is an object of the invention to provide an improved stabilizing base for providing stability to a conventional drinking cup.

It is a further object of the present invention to provide such a base which is selectively detachable from the cup, and may also be used as a coaster.

It is a further object of the present invention to provide such a base which includes a spill tray to contain spillage from the cup.

It is a further object of the present invention to provide such a base which contains spills from the cup even when the cup is positioned for drinking.

Other objects, features and advantages of the present invention will become apparent upon reading the following detailed description in conjunction with the drawings and the claims.

BRIEF DESCRIPTION OF THE DRAWINGS

FIG. 2 is a side cross sectional view along line 2—2 of FIG. 1.

FIG. 3 is an isolated view of the contacting point between the contacting ridge of the cup base and the cup of FIGS. 1 and 2.

DESCRIPTION OF THE DISCLOSED EMBODIMENTS

Figure 1:
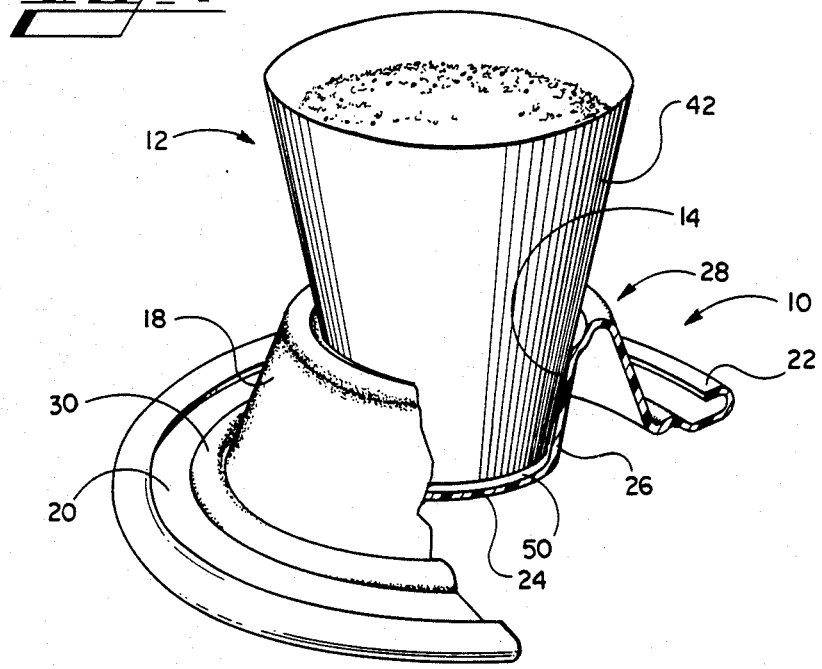
FIG. 1 is a pictorial view of a first embodiment of a cup base embodying the invention, partially cut away to illustrate the mating relationship between the base and a typical cup.

Referring now in detail to the drawing, in which like numerals represent like parts throughout the several views, FIGS. 1 and 2 show a first embodiment of the drinking cup coaster - stabilizing base 10 of the present invention. The base 10 is of a unitary construction, may be selectively attached to a typical cup 12, and generally includes a cup-accepting central cavity 14, a conical outer wall 18, a tray portion 20, and an annular turned-back ridge 22.

For purposes of effective explanation, reference may be made herein to "central", "outer", "lower" "inside", or "outside" portions of various elements throughout this description. It should be understood that such references are merely relative terms, and are made only in reference to the views shown in the accompanying figures. Furthermore, it should be understood that the first preferred embodiment of the base 10 is symmetrical about a central axis, which is vertical during normal operation of the base.

The central cavity 14 is located in the center of the base 10, and is defined by a circular floor portion 24, and a conical side wall 26. The floor portion 24 lies in a substantially horizontal plane. The conical side wall 26 extends upwardly and outwardly at a draft angle $\beta$ from vertical away from the outer edge of the floor portion 24, and terminates at a circular mouth 28, which lies in a substantially horizontal plane. Therefore it may be seen that the central cavity 14 is in the general form of an inverted truncated cone.

It should be noted that the central cavity 14 is configured to accept the lower end of the cup 12, as discussed in further detail later in this application.

The outer conical wall 18 of the base 10 extends outwardly and downwardly from the mouth 28, and has a lower edge terminating at an annular structural rib 30, which lies in a substantially horizontal plane lower than that of the floor portion 24. The structural rib 30 provides structural rigidity to the base 10, and also retains spillage from the cup 12 as discussed in detail later in this application.

The tray portion 20 is substantially planar, extends outwardly from the structural rib 30 in a substantially horizontal plane, and terminates in the turned-back annular ridge 22. The tray portion 20 defines an underside 32 upon which the base 10 rests during use.

Referring now to FIG. 3, the particular configuration of the mouth 28 of the base is now described. The mouth 28 includes an annular contacting ridge 34, and an annular moisture trap recess 36 disposed just above the contacting ridge. As discussed later in this applicaton, the contacting ridge 34 contacts the outside walls 42 of a cup 12 when inserted into the central cavity 14.

The cup 12 is of typical configuration, and includes a circular base 40 and a conical side wall 42 extending upwardly and outwardly at a draft angle $\partial$ from vertical away from the outer edge of the circular base, and defines an upwardly disposed open end 44.

The steps of assembly of the cup 12 and the base 10 are now discussed. The supporting surface 32 of the base 10 is placed upon a relatively flat surface such as a tabletop, such that the central cavity 14 is upwardly disposed. The lower end of the cup 12 is inserted into the central cavity 14 of the base 10 such that the outer surface of the side wall 42 of the cup contacts the contacting ridge 34 of the base, but the cup does not contact any other portion of the base, including the floor portion 24 defining the cavity. It should be understood that this mating relationship may only be achieved if the cup draft $\partial$ of the side wall 42 of the cup 12 is greater than the base draft $\beta$ of the side walls of the central cavity 14, and the diameter of the contacting ridge is less than the outer diameter of the extreme upper end of the cup 12, and greater than the outer diameter of the base of the cup. It should of course be understood that the particular configuration of each cup 12 will dictate at which point the cup will contact the contacting ridge of the base 10. As the applicant has determined that a majority of conventional cups, in particular disposable cups, have side wall drafts between 7 and 15 degrees, the side wall 26 of the applicant's device in the preferred embodiment has a draft of less than 7 degrees. It should be understood that other draft configurations may be used without departing from the spirit and scope of the present invention.

If the cup 12 is filled with liquid and placed into the central cavity 14 of the base 10 while the underside 32 of the base is placed upon a relatively horizontal planar surface (not shown), a friction fit is provided between the contacting ridge 34 of the base 10 and the side wall 42 of the cup 12, and the cup is maintained in an upright position. However, the contacting ridge 34 is configured such that the cup 12 may be removed from the base 10 by simply lifting the cup from the base, and allowing the base to fall from the cup under the influence of gravity. Therefore it should be understood that the base 10, when used in this manner, acts similar to a coaster, as it is not attached to the cup 12 during drinking, but instead remains on the planar surface to accept and support the cup when desired.

If it is desired to use the base 10 as an attached stabilizer, the cup 12 is placed in the base 10 in a manner similar to that just discussed. At this point, it should be understood that although the central cavity 14 is substantially filled by the lower portion of the cup 12, a residual space 50 between the base and the cup exists and is effectively "sealed off" from the outside atmosphere.

A downward force is then applied to the cup 12 such that air is forced out of the residual space 50 and past the contact point between the cup 12 and the contacting ridge 34. When the downward force is released, the contacting relationship between the contacting ridge 34 and the cup 12 is such that an airtight seal is maintained between the cup and the contacting ridge, and a partial vacuum is created in the residual space 50. Therefore it may be understood that a pressure differential exists between air trapped in the residual space 50, and the atmospheric air. This pressure differential, combined with the previously-discussed friction fit between the base 10 and the cup 12, is sufficient to maintain the base in a continuous mating relationship with the cup even when the cup is lifted from the supporting surface. Therefore it may be seen that, when in this mode of operation, the base 10 effectively functions as a stabilizer which is continuously attached to the cup. The base 10 may be separated from the cup 12 by simply pulling them apart by hand.

Should the fluid within the cup be relatively cold, the fluid causes the walls of the cup to become similarly cold, and condensation may tend to form on the outside walls of the cup. As the condensation accumulates, it may also tend to drip downwardly along the walls of the cup 12, until it encounters the interface of the contacting ridge 34 and the conical side wall of the cup, and accumulates in the moisture trap 36. It should be understood that this will further encourage the effectiveness of the airtight seal between the base 10 and the cup 12.

As previously discussed, the structural rib 30, the tray portion 20, and the turned-back ridge 22 are disposed about the base 10. These elements combine to retain spillage or excess condensation from the cup, thus preventing the spillage from staining or damaging the surfaces upon which the base 10 is placed.

The turned-back ridge 22 is of particular interest regarding the retention of spilled liquid. As previously discussed, it may be desirable to attach the base 10 to the cup 12 during drinking from the cup. It should be understood that the turned-back nature of the ridge 22 allows the ridge to retain spillage even during inversion of the cup 12 during drinking.

Should it be desired to use the base 10 as a coaster, a further advantage of the particular mating configuration of the cup 12 and base should be understood. In the event that some spillage is present along the base of the cup 12 when the cup is placed into the base, the spillage may tend to drop from the cup and down upon the floor portion 24 within the central cavity 14. If so, the spillage will remain in the central cavity 14 when the cup is raised for drinking, and will not drip undesirably from the cup bottom during drinking.

Figure 4:
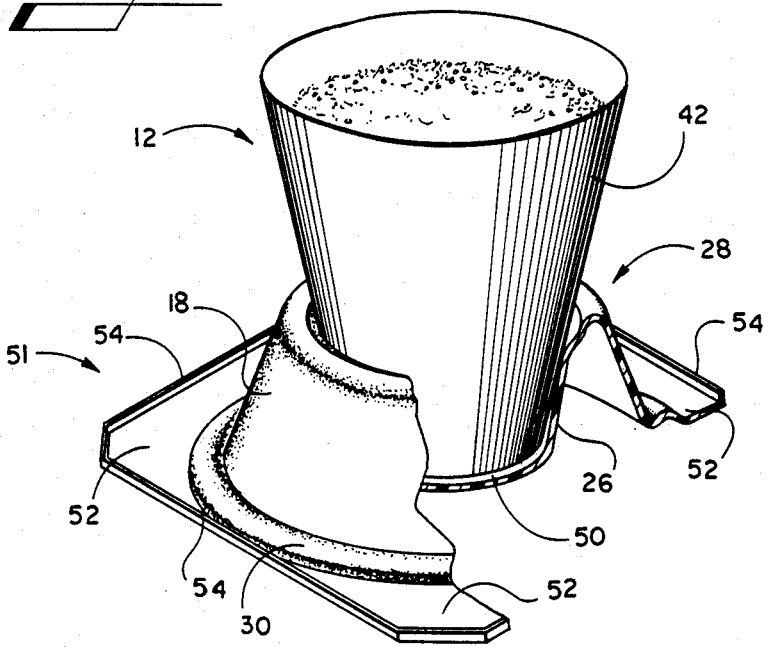
FIG. 4 is a pictorial view of a second embodiment of a cup base embodying the invention, partially cut away similar to FIG. 1.

FIG. 4 discloses an alternative base configuration 51 embodying the present invention, which includes an alternative square tray portion 52 having vertical walls 54 disposed about the outer edges of the tray. This alternative configuration is configured such that the base 51 and an attached cup 12 may be placed within a conventional take-out bag (not shown) such as that used in the fast-food industry. As these conventional bags commonly have rectangular floors, it should be understood that the base 51 is configured to fit within the bag such that opposing sides of the base fit snugly against the longer walls of the take-out bag. It should also be understood that although this embodiment does not include a turned-back outer rim, such a rim could provided.

While the cup 12 it is illustrated as being constructed of plastic, in particular a thermoplastic, it may nevertheless be constructed of a plastic or wax covered paperboard, metal, metal foil, or glass without departing from the spirit and scope of the present invention. Furthermore, it is not necessary that the cup 12 be disposable.

The preferred embodiment of the invention discloses the base being of unitary construction, and formed out of a single-thickness material, shaped to allow the base to be stacked along with other similarly-shaped bases. The turned-back ridge 22 or vertical walls 54 (depending upon the embodiment) act as "denesting lugs", which maintain some spacing between stacked bases, and allow the bases to be readily separated from a stack. However, it should be understood that other configurations, including solid-body configurations, could be used without departing from the spirit and scope of the present invention.

Therefore it may understood that the base 10 of the present invention has several advantages over the prior art. One advantage is that the base accepts various cup sizes, unlike the bases in the prior art, which were size specific. Another advantage of the base of the present invention may be used as either a detached coaster, or as an attached stabilizer. The base also captures spillage from the cup, and, should the base be used as an attached stabilizer, one preferred embodiment will retain this spillage even when the cup is positioned for drinking. Lastly, the base design is simple in design and construction, and is readily stacked along with other similarly shaped bases.

While the invention has been described in detail with particular reference to the disclosed embodiments, it will be understood that variations and modifications can be effected within the spirit and scope of the invention as defined by the appended claims.

I claim:

1. A combination drinking cup coaster-stabilizer for attachment about the lower portion of a drinking cup having a cup floor portion and a cup side wall and for placement upon a surface, comprising a base having a recess configured for accepting the lower portion of an upright drinking cup and maintaining said cup in an upright position such that a residual space at least partially defined by said cup side wall is formed between said base and said cup, said recess defining a mouth positioned to maintain continuous sealing contact about the outer surface of said cup such that a partial vacuum may be formed in said residual space for maintaining said cup within said base.

2. The coaster-stabilizer of claim 1, wherein said mouth includes a contacting ridge disposed about said mouth, and wherein said continuous contact is relatively airtight.

3. The coaster-stabilizer of claim 2, wherein said mouth includes a moisture trap for trapping moisture which tends to drip down said outer surface of the cup, said moisture trap being positioned such that said moisture encourages said airtight contact.

4. The coaster-stabilizer of claim 2, wherein said mouth includes an annular moisture trap for trapping moisture which tends to drip down said outer surface of the cup, said moisture trap being positioned above said contacting ridge such that said moisture is directed toward the contact point between said outer surface of the cup and said contacting ridge, such that said moisture encourages airtight contact at said contact point.

5. The coaster-stabilizer of claim 4, wherein said base comprises;

an upstanding portion defining said recess; and a substantially planar tray portion extending outwardly relative from said upstanding portion.

6. The coaster-stabilizer of claim 5, further comprising a peripheral turned-back rim positioned at the outer perimeter of said tray portion for containing spillage.

7. The coaster-stabilizer of claim 2, wherein said base comprises;

an upstanding portion defining said recess; and a substantially planar tray portion extending outwardly relative from said upstanding portion.

8. The coaster-stabilizer of claim 7, further comprising a peripheral turned-back rim positioned at the outer perimeter of said tray portion for containing spillage.

9. A combination drinking cup coaster-stabilizer for placement upon a surface and for receiving the bottom portion of a drinking cup, said drinking cup having a cup circular floor portion and a cup conical wall extending upwardly and tapering outwardly from said cup circular floor portion at a cup draft angle from an axis normal to said cup circular floor portion, said coaster-stabilizer comprising;

a base for placement upon a supporting surface, said base having a cup-receiving recess, said cup-receiving recess being defined by a base circular floor portion, a base conical interior side wall extending upwardly and tapering outwardly from said base circular floor portion at a base draft angle from an axis normal to said base circular floor portion less than said cup draft angle, and terminating at a circular mouth, said mouth defining an annular contacting ridge for continuous contact about the outer surface of the cup conical wall such that a residual space is formed between the cup and said base when the cup is placed into said base, and such that a partial vacuum may be formed in said residual space for maintaining the cup within said base.

10. The combination drinking cup coaster-stabilizer of claim 9, wherein said mouth includes an annular moisture trap for trapping moisture which tends to drip down said outer surface of the cup conical wall, said moisture trap being positioned above said contacting ridge such that said moisture is directed toward the contact point between the outer surface of the cup and said contacting ridge, such that said moisture encourages airtight contact at said contact point.

11. The coaster-stabilizer of claim 10, wherein said base further comprises a substantially planar tray portion extending outwardly relative to said recess and configured to contain spillage from the cup.

12. The combination drinking cup coaster-stabilizer of claim 9, further comprising a peripheral turned-back rim positioned at the outer perimeter of said tray portion for containing spillage.

13. The coaster-stabilizer of claim 10, wherein said base further comprises:

a base outer wall extending downwardly from said mouth; and a substantially planar tray portion extending outwardly from said base outer wall and configured to contain spillage from the cup.

14. The combination drinking cup coaster-stabilizer of claim 13, further comprising a peripheral turned-back rim positioned at the outer perimeter of said tray portion for containing spillage.

15. The coaster-stabilizer of claim 9, wherein said base further comprises:

a base outer conical wall extending downwardly from said mouth; and a substantially planar tray portion extending outwardly from said base outer wall and configured to contain spillage from the cup.

16. The combination drinking cup coaster-stabilizer of claim 15, further comprising a peripheral turned-back rim positioned at the outer perimeter of said tray portion for containing spillage.

17. A combination drinking cup coaster-stabilizer for placement upon a surface and for receiving the base of a drinking cup, said drinking cup having a cup circular floor portion and a cup conical wall extending upwardly and tapering outwardly from said cup circular floor portion at a draft angle X from an axis normal to said cup circular floor portion, said coaster-stabilizer comprising:

a circular floor portion, a conical side wall extending upwardly and tapering outwardly from said circular floor portion at a draft angle less than X from an axis normal to said circular floor portion, and terminating at a first circular mouth, said first mouth defining an annular contacting ridge for continuous contact about the outer surface of the conical wall of the cup such that a residual space is formed between the cup and said base when the cup is placed into said base, and such that a partial vacuum may be formed in said residual space for maintaining the cup within said base;

an outer conical wall extending downwardly and outwardly from said mouth;

a substantially planar tray portion extending outwardly from the bottom of said outer conical wall; and a peripheral turned-back rim positioned at the outer perimeter of said tray portion for containing spillage.

18. The combination drinking cup coaster-stabilizer of claim 17, wherein the outer perimeter of said tray portion is substantially circular.

19. The combination drinking cup coaster-stabilizer of claim 17, wherein said tray portion is substantially rectangular.

20. A combination drinking cup coaster-stabilizer for attachment about the lower portion of a drinking cup and for placement upon a surface, said drinking cup having a cup circular floor portion and a cup conical wall extending upwardly and tapering outwardly from said cup circular floor portion, said coaster-stabilizer comprising:

a base having a recess configured for accepting the lower portion of said upright drinking cup and maintaining said cup in an upright position, said recess defining a mouth positioned to maintain continuous sealing contact about the outer surface of said cup and being shaped such that an annular residual space beginning adjacent to said mouth and being partially defined by said cup conical wall is formed between said base and said cup, and a partial vacuum is formed in said residual space for maintaining said cup with said base, said mouth being the only point of contact between the base and the cup.

21. The coaster-stabilizer of claim 20, wherein said mouth includes a contacting ridge disposed about said mouth, and wherein said continuous contact is relatively airtight.

22. The coaster-stabilizer of claim 21, wherein said mouth includes a moisture trap for trapping moisture which tends to drip down said outer surface of the cup, said moisture trap being positioned such that said moisture encourages said airtight contact.

23. The coaster-stabilizer of claim 21, wherein said mouth includes an annular moisture trap for trapping moisture which tends to drip down said outer surface of the cup, said moisture trap being positioned above said contacting ridge such that said moisture is directed toward the contact point between said outer surface of the cup and said contacting ridge, such that said moisture encourages airtight contact at said contact point.

24. The coaster-stabilizer of claim 23, wherein said base comprises;

an upstanding portion defining said recess; and a substantially planar tray portion extending outwardly relative from said upstanding portion.

25. The coaster-stabilizer of claim 24, further comprising a peripheral turned-back rim positioned at the outer perimeter of said tray portion for containing spillage.

26. The coaster-stabilizer of claim 21, wherein said base comprises;

an upstanding portion defining said recess; and a substantially planar tray portion extending outwardly relative from said upstanding portion.

27. The coaster-stabilizer of claim 26, further comprising a peripheral turned-back rim positioned at the outer perimeter of said tray portion for containing spillage.

28. The coaster-stabilizer of claim 9, said base draft angle approximating or being less than seven degrees.

29. The coaster-stabilizer of claim 9, said base draft angle being less than seven degrees.

30. The coaster-stabilizer of claim 9, said base draft angle being approximately seven degrees.

31. The coaster-stabilizer of claim 9, said cup draft angle being in the range of seven and fifteen degrees, and said base draft angle being less than seven degrees.

* * * * *